United States Patent [19]

Ayash

[11] 4,088,481

[45] May 9, 1978

[54] EXTENDED RANGE COLOR ELECTROPHOTOGRAPHIC METHOD BY SUPERIMPOSING A HALF-TONE IMAGE ON A LOW DENSITY CONTINUOUS TONE IMAGE

[75] Inventor: Karl B. Ayash, Webster, N.Y.

[73] Assignee: Xerox Corporation, Stamford, Conn.

[21] Appl. No.: 647,468

[22] Filed: Jan. 8, 1976

Related U.S. Application Data

[62] Division of Ser. No. 513,685, Oct. 10, 1974.

[51] Int. Cl.[2] ..... G03G 13/14

[52] U.S. Cl. ..... 96/1.4; 96/1.2

[58] Field of Search ..... 96/1.3, 1.1, 1, 1.4, 96/1.2

[56] References Cited

U.S. PATENT DOCUMENTS

| | | | |
|---|---|---|---|
| 2,598,732 | 6/1952 | Walkup | 96/1.4 |
| 2,868,642 | 1/1959 | Hayford et al. | 96/1.3 |
| 3,248,216 | 4/1966 | Weigl | 96/1.3 |
| 3,583,868 | 6/1971 | Noble et al. | 96/1 TE |

*Primary Examiner*—Edward C. Kimlin
*Assistant Examiner*—John L. Goodrow
*Attorney, Agent, or Firm*—J. J. Ralabate; C. A. Green; H. Fleischer

[57] ABSTRACT

An electrophotographic printing machine and method of use therefor in which a first image having a density less than that of the original document being reproduced is formed on a sheet of support material. A half-tone image having substantially the density of the original document is reproduced, in superimposed registration with the first image, on the sheet of support material. This produces a high quality copy having substantially the density of the original document.

8 Claims, 6 Drawing Figures

EXTENDED RANGE COLOR ELECTROPHOTOGRAPHIC METHOD BY SUPERIMPOSING A HALF-TONE IMAGE ON A LOW DENSITY CONTINUOUS TONE IMAGE

This is a division, of application Ser. No. 513,685, filed Oct. 10, 1974.

The foregoing abstract is neither intended to define the invention disclosed in the specification, nor is it intended to be limiting as to the scope of the invention in any way.

BACKGROUND OF THE INVENTION

This invention relates generally to an electrophotographic printing machine, and more particularly concerns an improved printing process for producing high quality color reproductions.

In the process of electrophotographic printing, a light image of an original document exposes a charged photoconductive surface. The irradiated area of the photoconductive surface are discharged recording thereon an electrostatic latent image corresponding to the original document. A development system positions a developer mix of carrier granules and toner particles in contact with the electrostatic latent image recorded on the photoconductive surface. Toner particles are attracted electrostatically from the carrier granules to the latent image forming a toner powder image thereon. The toner powder image is then transferred to a sheet of support material. After the toner powder image is placed on the sheet of support material, it advances to a fuser which permanently affixes the toner powder image thereto. This process is more fully described in U.S. Pat. No. 2,297,691 issued to Carlson in 1942.

With the development of magnetic brush systems and electrically biased electrodes for cascade development systems, it has been feasible to reproduce images containing lines and solid areas of various shades. The introduction of screening techniques have further extended the range of electrophotographic printing to half-tone images. However, it is extremely difficult to create the full latitude of tone contrast that is possible in conventional photography. Techniques which accomplish this require extremely complex equipment and highly sensitive controls which must be continually monitored during the printing process.

The technique of increasing the cynamic range or the brightness acceptance of an electrophotographic printing machine is frequently referred to as extended range electrophotographic printing. One approach to extended range electrophotographic printing is described in U.S. Pat. No. 3,212,889 issued to Gundlach et al in 1965. As described therein, a photoconductive plate is charged, exposed to a light image of a pre-selected magnitude, developed and transferred to a support sheet. Residual toner particles are cleaned from the photoconductive plate and the photoconductive plate is then resensitized and re-exposed to a second light image or the original document having a different magnitude than the first light image thereof. The second image is developed and transferred, is superimposed registration with the first image, onto the common sheet of support material. The foregoing process may be repeated a plurality of times to form successive toner powder images for different magnitudes of exposure. Another approach is described in co-pending application Ser. No. 497,547 filed in 1974. As described therein, different concentrations of toner particles within the developer mix are employed to develop the electrostatic latent images recorded on the photoconductive surface. The foregoing electrostatic latent images are also produced with different magnitude light images.

It is a primary object of the present invention to improve electrophotographic printing so as to form half-tone copies having substantially the density of the original document.

SUMMARY OF THE INVENTION

Briefly, stated, and in accordance with the present invention, there is provided an electrophotographic printing machine for reproducing an original document.

Pursuant to the features of the present invention, means are provided for forming a first powder image having a density less than that of the original document on a sheet of support material. In addition, means are provided for forming a half-tone powder image having substantially the density of the original document. The half-tone powder image and the first powder image are disposed, in superimposed registration with one another, on a common region of the sheet of support material creating a copy of the original document thereon.

BRIEF DESCRIPTION OF THE DRAWINGS

Other objects and advantages of the present invention will become apparent upon reading the following detailed description and upon reference to the drawings, in which.

Figure 1:
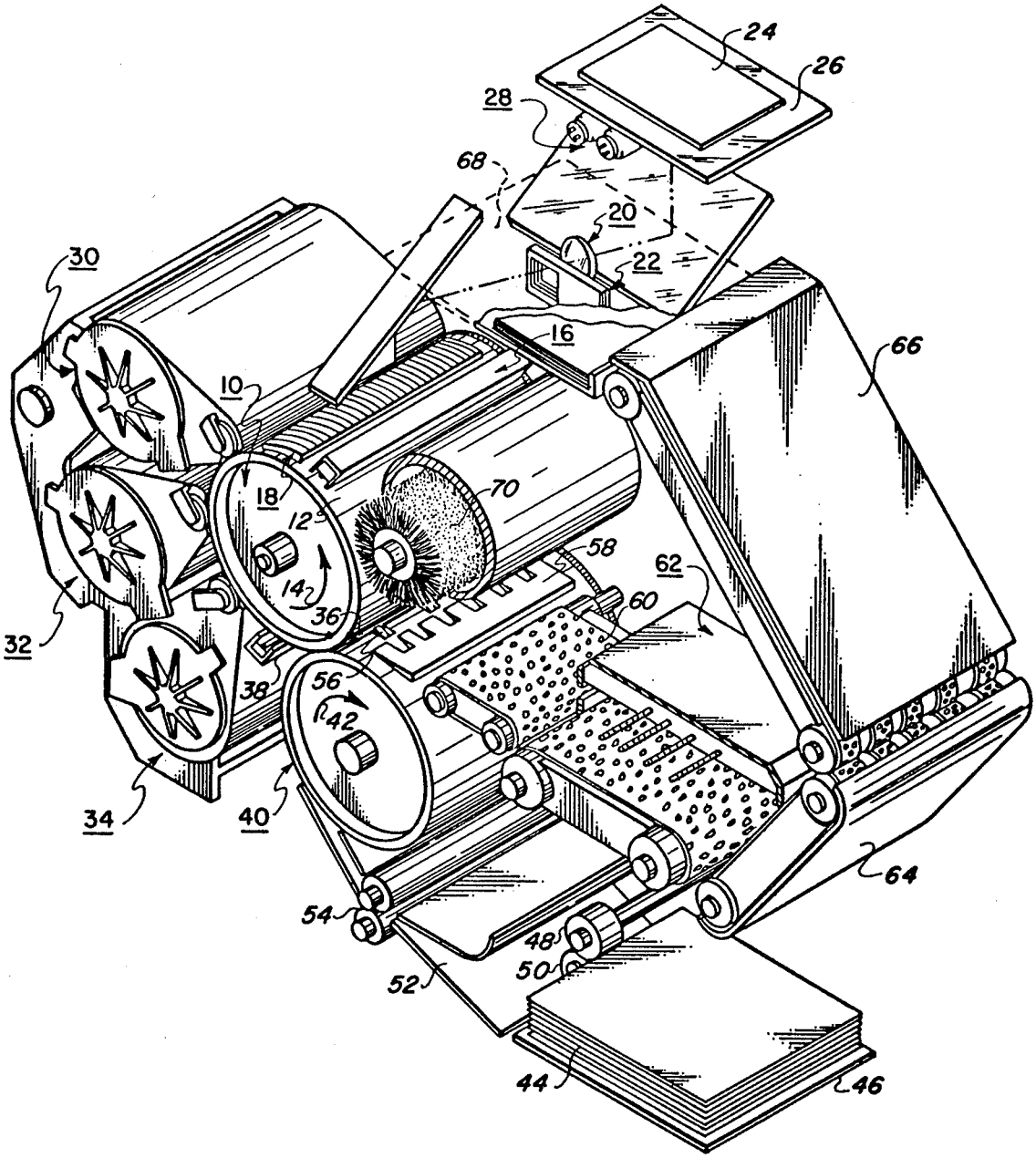
FIG. 1 is a schematic perspective view of an electrophotographic printing machine incorporating the features of the present invention therein.

While the present invention will hereinafter be described in connection with a preferred embodiment and method of use therefor, it will be understood that it is not intended to limit the invention to that embodiment or method of use. On the contrary, it is intended to cover all alternatives, modifications and equivalents as may be included within the spirit and broad scope of the invention as defined by the appended claims.

DETAILED DESCRIPTION OF THE INVENTION

For a general understanding of the disclosed electrophotographic printing machine, continued reference is had to the drawings. In the drawings, like reference numerals have been used throughout to designate like elements. Initially, the overall process for producing copies will be described with reference to FIG. 1. Thereafter, the detailed structural configuration of the various sub-assemblies employed in the FIG. 1 printing machine will be discussed. Although the method and apparatus of electrophotographic printing, as described herein, is particularly well adapted for use in a color machine, it should become evident from the following discussion that it is equally well suited for producing black and white copies, and is not necessarily limited to the particular apparatus described herein.

As depicted in FIG. 1, the electrophotographic printing machine employs a drum 10 having a photoconductive surface 12 secured to and entrained thereabout. Drum 10 is mounted rotatably within the machine (not shown) and rotates in the direction of arrow 14. One type of suitable photoconductive material is described in U.S. Pat. No. 3,655,377 issued to Sechak in 1972. A series of processing stations are disposed about the periphery of drum 10. Thus, as drum 10 rotates in the direction of arrow 14, it passes sequentially through each processing station. Drum 10 is driven at a predetermined speed relative to the other machine operating mechanisms from a common drive motor (not shown). A timing disc mounted in the region of one end of the shaft of drum 10 cooperates with the machine logic to synchronize the various operations.

Initially, drum 10 rotates photoconductive surface 12 through charging station A. At charging station A, a corona generating device, indicated at 16, extends in a longitudinal direction transversely across photoconductive surface 12. Corona generating device 16 will be described hereinafter in greater detail with reference to FIG. 2. As photoconductive surface 12 passes beneath corona generating device 16, ions are sprayed thereon producing a relatively high substantially uniform charge thereover.

After photoconductive surface 12 is charged to a substantially uniform potential, drum 10 is rotated to exposure station B. At exposure station B, a color filtered light image of the original document is projected onto charged photoconductive surface 12. This records a single color electrostatic latent image on photoconductive surface 12. After a plurality of single color electrostatic latent images (in this case three) have been recorded on photoconductive surface 12, each corresponding to a prescribed color filtered light image, screen 18 is interposed into optical path to form a modulated electrostatic latent image on photoconductive surface 12. Thereafter, the successive modulated electrostatic latent images are formed on photoconductive surface 12. Each of the modulated electrostatic latent images correspond to the respective single color light image transmitted through screen 18. Exposure station B includes, in addition to screen 18, a moving lens system, generally designated by the reference numeral 20, and a color filter mechanism shown generally at 22. An original document 24, such as a sheet of paper, book or the like is placed face down upon transparent viewing platen 26. Lamps 38, positioned beneath platen 24, move in a timed relationship with lens 20 and filter mechanism 22 to scan successive incremental areas of original document 24 disposed thereon. In this manner, a flowing light image of original document 24 is projected onto charged photoconductive surface 12. Filter mechanism 22 is adapted to interpose selected color filters into the optical path during the exposure process. The appropriate filter operates on the light rays transmitted through lens 22 to record an electrostatic latent image on photoconductive surface 12 corresponding to a preselected spectral region of electromagnetic wave spectrum, hereinafter referred to as a single color electrostatic latent image. In operation, three successive single color electrostatic latent images are recorded on photoconductive surface 12. These correspond to a green, blue and red filtered light image. After the foregoing three single color electrostatic latent images are recorded, screen 18 is interposed into the optical light path. Once again, blue, green and red light images are projected through screen 18 recording successive modulated single color electrostatic latent images on photoconductive surface 12. The exposure system will be discussed in greater detail with reference to FIG. 3.

After the electrostatic latent image is recorded on photoconductive surface 12, drum 10 rotates to development station C. At development station C, three individual developer units, generally indicated by the reference numerals 28, 30 and 32, respectively, are arranged to render visible the electrostatic latent and modulated electrostatic latent images recorded on photoconductive surface 12. Preferably, the developer units are all of a type generally referred to in the art as "magnetic brush developer units". A typical magnetic brush development system employs a magnetizable developer mix which comprises carrier granules and toner particles. Generally, the toner particles are heat settable. In operation, the developer mix is continually brought through a directional flux field to form a brush thereof. The electrostatic latent image and modulated electrostatic latent image recorded on photoconductive surface 12 are brought into contact with the brush or developer mix. Toner particles are attracted from the developer mix to the latent image. Each of the developer units contained appropriately colored toner particles. For example, a single color electrostatic latent image formed from a green filtered light image is developed with magenta toner particles. Similarly, a single color electrostatic latent image formed from a blue filtered light image is developed with yellow toner particles, and a single color electrostatic latent image formed from a red filtered light image is developed with cyan toner particles. After all of the single color electrostatic latent images have been developed with their respectively colored toner particles, the modulated single color electrostatic latent images are developed. These images are developed with the same toner particles as those employed for the single color electrostatic latent images. Thus, a modulated single color electrostatic latent image formed from a green filtered light image is developed with magenta toner particles, one formed from a blue filtered light image is developed with yellow toner particles and one formed from a red filtered light image is developed with cyan toner particles. It should be noted that the electrical bias on each of the developer units is adjusted such that the density of the copy printer to the interposition of screen member 18 in the optical path will be about 0.6 that of the original document. After screen member 18 is interposed into the optical path, the electrical bias is adjusted so that the density of the copy corresponds substantially to that of the original document. The development system employed in the FIG. 1 printing machine will be discussed in greater detail with reference to FIG. 4.

Drum 10 is next rotated to transfer station D where the powder image adhering electronically to photoconductive surface 12 is transferred to a sheet of support material 36. Support material 36 may be plain paper or a sheet of thermoplastic material, amongst others. Transfer station D includes corona generating means, indicated generally at 38, and a transfer member, generally designated by the reference numeral 40. Corona generator 38 is excited by an alternating current and is arranged to pre-condition the toner powder image adhering electrostatically to photoconductive surface 12. In this manner, the pre-conditioned toner powder image will be more readily transferred from the electrostatic latent image recorded on photoconductive surface 12 to support material 34 by transfer member 40. Transfer member 40 is a roll adapted to recirculate support material 36 and is electrically biased to a potential of sufficient magnitude and polarity to attract electrostatically the preconditioned toner particles from the latent image recorded on photoconductive surface 12 to support material 36. Transfer roll 40 rotates in synchronism with drum 10 to maintain the latent image recorded on photoconductive surface 12 in registration with support material 36 secured releasably thereto. Inasmuch as support material 36 is secured releasably on transfer member 40, for movement in a recirculating path therewith, successive toner powder images may be transferred thereto, in superimposed registration with one another. In this case, transfer roll 40 rotates, in the direction of arrow 42, at substantially the same angular velocity as drum 10. This enables six toner powder images to be transferred to support material 36, is superimposed registration with one another. Initially, yellow, magenta and cyan toner powder images are formed without the use of screen 18. Thereafter, yellow, magenta and cyan toner powder images are formed with the use of screen 18. Thus, six successive toner powder images are transferred to support material 36, in superimposed registration with one another. Corona generator 38 and transformer member 40 will be described hereinafter in greater detail with reference to FIG. 5.

Prior to proceeding with the description of the remaining components disposed about the periphery of drum 10, the sheet feeding path will be briefly described. Support material 36 is advanced from a stack 44 thereof mounted on a tray 46. Feed roll 48, in operative communication with retard roll 50, advances and separates the uppermost sheet from stack 44. The advancing sheet moves into sheet 52 which directs it into the nip between register rolls 54. Thereafter, gripper fingers, indicated generally as 56, mounted on transfer roll 40 secure releasably thereon support material 36 for movement therewith in a recirculating path. After the requisite number of toner powder images (in this case six) have been transferred to support material 36, gripper fingers 56 space support material 36 from transfer roll 40. Stripper bar 58 is then interposed therebetween to separate support material 36 from transfer roll 40. Thereafter, endless belt conveyor 60 advances support material 36 to fixing station E.

At fixing station E, a fuser, indicated generally at 62, permanently affixes the multi-layered toner powder image to support material 36. Fuser 62 will be described hereinafter, in greater detail, with reference to FIG. 6. After the fusing process, support material 36 is advanced by endless belt conveyors 64 and 66 to catch tray 68 permitting subsequent removal therefrom by the machine operator.

Although a preponderance of the toner particles are transferred to support material 36, invariably some residual toner particles remain on photoconductive surface 12 after the transfer of the powder images therefrom. Residual toner particles are removed from photoconductive surface 12 as it passes through cleaning station F. The residual toner particles are initially brought under the influence of a cleaning corona generating device (not shown) adapted to neutralize the electrostatic charge remaining on the residual toner particles and photoconductive surface 12. The neutralized toner particles are then cleaned from photoconductive surface 12 by a rotatably mounted fibrous brush 70 in contact therewith. A suitable brush cleaning device is described in U.S. Pat. No. 3,590,412 issued to Gerbasi in 1971.

It is believed that the foregoing description is sufficient for purposes of the present application to illustrate the general operation of a color electrophotographic printing machine employing the features of the present invention therein.

Figure 2:
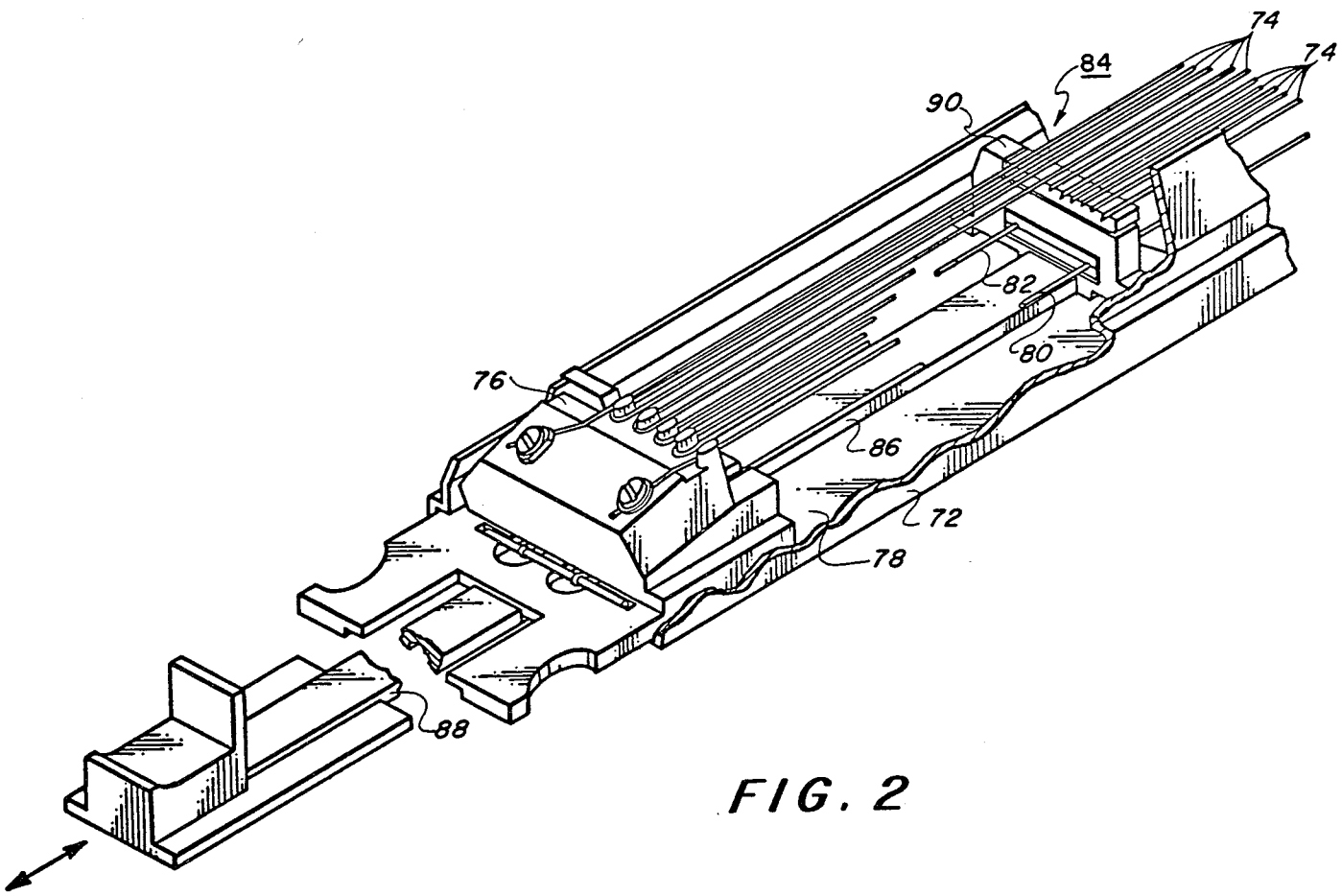
FIG. 2 is a perspective view of the corona generator employed in the FIG. 1 printing machine.

Referring now to the specific subject matter of the various sub-assemblies of the FIG. 1 printing machine, FIG. 2 depicts corona generating apparatus 16 in detail. Corona generating apparatus 16 includes an elongated conductive shield 72 defining an open-ended chamber opposed from and closely spaced to photoconductive surface 12. Shield 72 is a U-shaped housing, and, preferably, is made from an aluminum extrusion. A plurality of substantially parallel spaced, fine conductive wires 74 (in this case 10) extend in a longitudinal direction from one end of shield 72 to the other end thereof and across about three-quarters of the open end of the chamber therein. An insulating plate 76 is affixed permanently to both ends of shield 72 by suitable means (not shown), e.g. fasteners. Interposed between grid wires 74 and back wall 78 of shield 72 are a pair of coronode wires 80 and 82, respectively. Coronode wires 80 and 82 are suitably secured to insulating plates 76, preferably by fasteners (not shown). Both grid wires 74 and coronode wires 80 and 82, respectively, are preferably made from a conductive material such as platinum. Insulating plate 76 is, preferably, made from a dielectric material such as a glass alkaline or polycarbonate plastic or the like. As illustrated in FIG. 2, coronode wire 82 is positioned in the portion of the chamber of shield 72 that is not covered by grid wire 74, i.e., grid wires 74 do not extend over this portion of the open end of shield 72. Grid wires 74 extend only across about ¾ of the open end of shield 72. This permits rapid and rough control of charging of photoconductive surface 12 in the lead section or the portion of shield 72 not covered by grid wires 74. Slow and well controlled charging is obtained in the trailing section or portion of shield 72 covered by grid wires 74. A high voltage source (not shown) excites coronode wires 80 and 82 to a voltage preferably ranging from about 6000 to about 8000 volts. The coronode current ranges from about 200 to about 500 microamperes. A low voltage source (not shown) excites grid wires 72 to, preferably about 800 volts.

In order to reduce the sensitivity of corona generating apparatus 16 to contamination, deposits of toner particles and dust collected on coronode wires 80 and 82, respectively, and grid wires 74 are removed therefrom by wiper member 84. Wiper member 84 is, preferably, formed of a slightly abrasive material such as felt, foam or expanded polyester. A support carriage generally indicated at 86, reciprocates wiper member 84 along coronode wires 80 and 82 and grid wires 74. Support carriage 86 includes an elongated rod 88 attached to support 90. Rod 88 extends through insulating plate 76. Preferably, rod 88 extends longitudinally through the center of shield 72. In this manner, an operator may grasp rod 88 to reciprocate wiper member 84 in a longitudinal direction. This causes wiper member 84 to remove dust particles from coronode wires 78 and 80, as well as from grid wires 72. Corona generating device 16 is described in greater detail in co-pending application Ser. No. 307,250 filed in 1972, the relevant portions of that disclosure being hereby incorporated into the present application.

Figure 3:
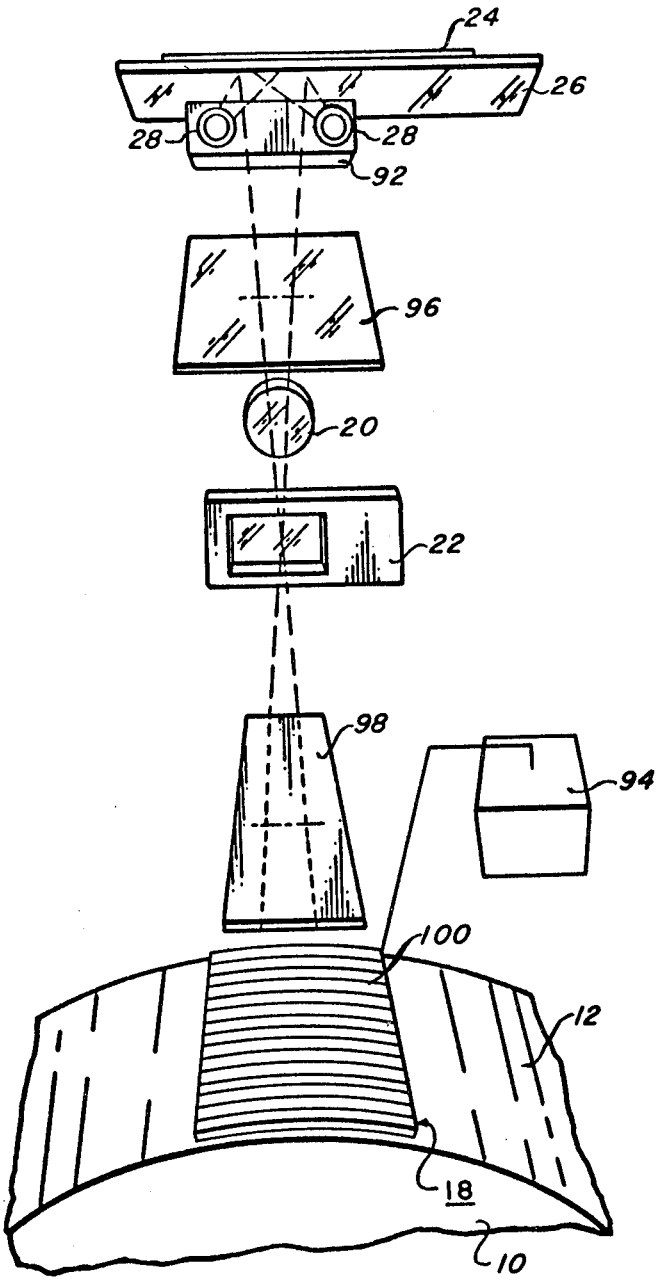
FIG. 3 is a schematic illustration of the optical system of the FIG. 1 printing machine.

Turning now to FIG. 3, exposure station B is described therein in greater detail. Lamp carriage 92 supports a pair of light sources or lamps 28 therein. Lamp carriage 92 traverses platen 26 illuminating incremental widths of original document 24 disposed thereon. Lamp carriage 92 is mounted by suitable means and driven by a cable pulley system from a drive motor rotating drum 10. As lamp carriage 92 traverses platen 26, another cable pulley acts to move lens 20 at a correlated speed therewith on suitable roller surrounding the shaft (not shown). Filter assembly 22 is mounted by a suitable bracket on lens 20 to move in conjunction therewith. Lamps 28, lens 20 and filter 22 scan original document 24 to create a flowing light image thereof. In this way, a light image of the original document is created by lens 20 and projected onto photoconductive surface 12. After a blue, red, and green light image has been projected onto charged photoconductive surface 12, screen 18 is interposed into the optical light path. At this time, blue, green and red light images are formed and transmitted through screen 18 producing modulated single color electrostatic latent images on charged photoconductive surface 12. The movement of screen 18 is controlled by moving mechanisms 94 having a solenoid and spring. Screen 68 is slidably mounted on a pair of rails (not shown). The spring resiliently urges screen member 18 out of the optical light path. When the solenoid is actuated, it overcomes the spring force and advances screen member 18 into the optical light path. The solenoid of moving mechanism 94 is periodically actuated by the logic circuitry associated with the timing disc mounted on photoconductive drum 10. Thus, after three successive light images have been projected onto photoconductive surface 12 without screen member 18 being in the optical light path, the solenoid of moving mechanism 94 is actuated and positions the screen member in the optical light path. The screen member remains in the optical light path as the next three successive light images are projected onto the charged photoconductive surface 12. Thus, six single color light images are projected onto the charged photoconductive surface 12, three being without screen member 18 in the optical light and three being with screen member 18 in the optical light path.

Continuing now with the description of the optical system, after original document 24 is scanned, platen 26, lens 18 and filter 22 are spring biased to return to their original position for the start of the next cycle. Similarly, lamps 28 return to their original position for the start of the next cycle. It should be clear that the movement of lens 20, filter 22 and lamps 28 is correlated with the speed of rotation of drum 10 for exposure of photoconductive surface 12. For greater details regarding the optical system described and its cooperation with the movement of drum 10, reference is made to U.S. Pat. No. 3,062,109 issued to Mayo et al. in 1962, the relevant portions thereof being hereby incorporated into the present application. It should be noted that mirror 96 directs the light rays reflected from original document 24 through lens 20. After passing through lens 20, the light rays are transmitted through filter 22. Thereafter, the light rays are reflected from a second mirror 98 onto the charged photoconductive surface 12 for the first three light images and through screen member 18 for the second three light images. in this way, the charge on photoconductive surface 12 is selectively dissipated in the irradiated areas forming three single color electrostatic latent images and three modulated single color electrostatic latent images.

By way of example, lens 18 is a six-element split dagor type of lens system having front and back compound lens components with a centrally located diaphragm therebetween. Lens 18 has a 31° field of angle and a speed of F4.5 at a 1:1 magnification. In addition, the lens is designed to minimize the effect of secondary color at the image plane. The front lens component has three lens elements including in the following order, a first lens element of positive power, a second lens element of negative power cemented to the first lens element, and a third lens element of positive power disposed between the second lens element and diaphragm. The back lens component also has three similar lens elements positioned so that lens 20 is symmetrical. In a specific embodiment of the lens, the first lens element in the front component is a double convex lens, the second lens element a double concave lens, and the third element a convex-concave lens element. For greater details regarding lens 20, reference is made to U.S. Pat. No. 3,592,531 issued to McCrobie in 1971, the relevant portion of that disclosure being hereby incorporated into the present application.

With continued reference to FIG. 3, filter 22 includes a housing which is mounted on lens 20 by a suitable bracket and moves in conjunction therewith during scanning as a single unit. The housing of filter 22 includes a window which is positioned relative to lens 20 to permit the light reflected from original document 24 on platen 26 to pass therethrough. The housing includes a plurality of tracks extending the entire width thereof. Each track is adapted to carry a filter thereon. The filters are biased into a position to be inserted into the window of the housing by individual extension springs. When not in operation, the color filters are located in the inoperative position spaced from the housing window. The filters are locked into position out of line of the housing window, by means of a stop pin which extends up through an opening in the bottom of the housing in the respective track of each filter. A solenoid arm, in association with the stop pin, retains the filters in the inoperative position. A selected color filter is inserted into the optical path of the housing window by activation of the appropriate solenoid. Activating the selected solenoid moves the stop pin in a downward direction away from the path of the filter thereby allowing the spring associated therewith to move the filter into the optical path of the housing window. When a filter is moved into the operative position in the housing window it will remain there throughout the entire scanning of the original document. After scanning is completed, the first color filter is removed from the operative position and a second color filter inserted therein. Preferably, filter mechanism 22 includes three color filters, a red filter, a blue filter and a green filter. Each of the filters is associated with its respective toner particles, i.e. the complement of the color thereof to produce a substractive system. A red filtered light image is developed with cyan toner particles, a green filtered light image is developed with magenta toner particles, and a blue filtered light image is developed with yellow toner particles.

Screen member 18 is formed on a transparent substrate which preferably may be made from a suitable plexiglass or glass material. A screen is printed on the transparent substrate by a suitable chemical etching technique. The screen itself may be made from any number of opaque metallic materials suitable for chemical etching such as copper or aluminum. Screen member 18 may have a plurality of equally spaced lines 100 thereon. Lines 100 may range from 100 to 400 lines per linear inch. An alternate embodiment would comprise a plurality of equally spaced dots rather than lines. The dots are formed on the transparent material and may be deposited thereon by a suitable evaporative or chemical etching technique.

One skilled in the art will realize that a variety of patterns may be used for screen member 18. Several examples of these patterns are rows of small squares surrounded by black or opaque areas, a checkerboard pattern of transparent and opaque areas, a transparent area continually covered with circular black or opaque dots, or a black or opaque background covered with a random distribution of transparent dots of various sizes. Any one of several screen patterns may be employed. The finer screen size generally results in a more natural or higher quality copy. Hence, while a coarse screen having 50 or 60 dots or lines to the linear inch will be useful for some purposes such as direct production of half-tone images, fine screens such as those having 100, 200, 300 and 400 or even more dots or lines to the linear inch will give a more nearly continuous tone appearance to the finished copy. With the finer screens, the screen pattern may be barely perceptible in the finished copy and the copy will have the appearance of a continuous tone photograph. The contrasting appearance obtained without the use of the screen is eliminated or greatly reduced and all large areas are rendered with apparently uniform density throughout.

Figure 4:
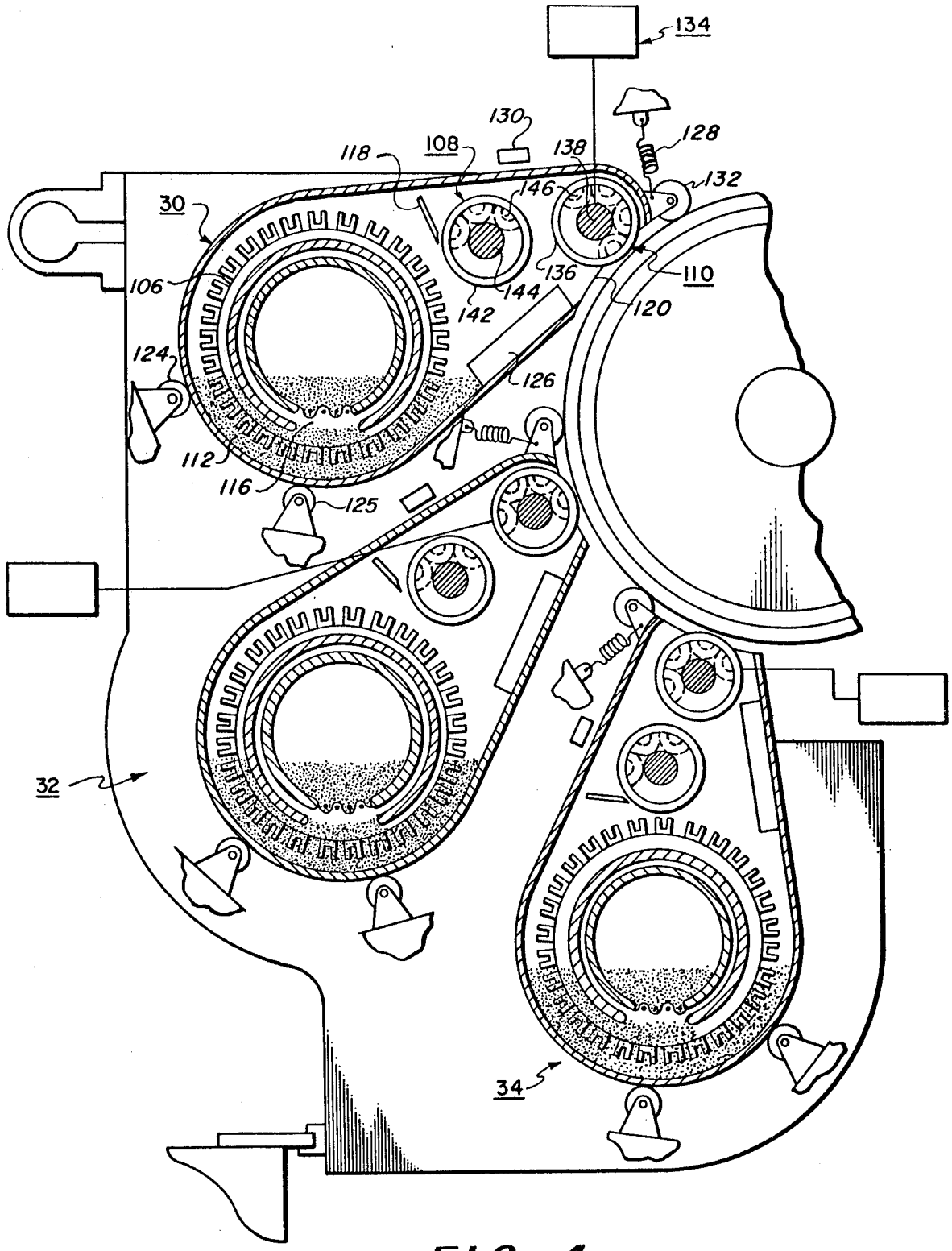
FIG. 4 is a sectional elevational view of the development system utilized in the FIG. 1 printing machine.

Referring now to FIG. 4, the development system of the FIG. 1 electrophotographic printing machine will be described in detail. As shown therein, frame 102 supports three toner depositing means or developer units 30, 32 and 34, respectively. The aforementioned development system is of the type employed at station C. These developer units are depicted in an elevational sectional view to indicate more clearly the various components employed therein. Only developer unit 30 will be described in detail as developer units 32 and 34 are nearly identical thereto. The distinction between each developer unit is the color of the toner particles contained therein and minor geometrical differences due to the mounting arrangement. Developer unit 30 may have yellow toner particles, unit 32, magenta toner particles, and unit 34 cyan toner particles. Once again, for purposes of explanation, developer unit 30 will hereinafter be described in detail.

The principle components of developer unit 30 are developer housing 104, conveyor means or paddle wheel 106, transport means or roll 108, and developer means or roll 110. Paddle wheel 106 is a cylindrical member with buckets or scoops disposed about the periphery thereof. It is adapted to rotate so as to elevate developer mix 112 from the lower region of housing 104 to the upper region thereof. When developer mix 112 reaches the upper region of housing 104, it is lifted from the paddle wheel buckets to transport roll 108. Alternate buckets of paddle wheel 106 have apertures in the root diameter so that the developer mix, in these areas, is not carried to transport roll 108 but, in lieu thereof, descends to the lower region of developer housing 104. As developer mix 112 falls back to the lower region of housing 104, it cascades over shroud 114 which is of a tubular configuration with aperture or slot 116 in the lower region thereof. Developer mix 112 is recirculated in this manner so that the carrier granules are continually agitated to mix with fresh toner particles. This generates a strong triboelectric charge between the carrier granules and toner particles. As developer mix 112, in the paddle wheel buckets, approaches transport roll 108, the magnetic fields produced by the fixed magnets therein attract developer mix 112. Transport roll 108 moves developer mix 112 to developer roll 110. Blade 118 controls the amount of developer mix 117 carried over the top of transport roll 108. Surplus developer mix 112 is sheared from transport roll 108 and falls in a downwardly direction toward paddle wheel 106. As developer mix 112 descends, it falls through the apertures of paddle wheel 106 in a downwardly direction into the lower region of housing 104. Developer mix 112 which passes metering blade 118 is carried over transport roll 108 to developer roll 110 and into development zone 120. Development zone 120 is located between photoconductive surface 12 and developer roll 110. The electrostatic latent image and modulated electrostatic latent image recorded on photoconductive surface 12 are developed by contacting moving developer mix 112. The charged areas of the photoconductive surface 12 electrostatically attract the toner particles from the carrier granules of developer mix 112. Upon passing from the development zone, the unused developer mix and the carrier granules enter into a region relatively free from magnetic forces and fall from developer roll 110 in a downwardly direction to the lower region of housing 104. As the unused developer mix and the carrier granules descend, they pass through mixing baffle 122 which diverts the flow from the ends toward the center of developer housing 104 to provide mixing in this direction.

Developer housing 104 is pivoted about the center of paddle wheel 106 and is supported at the lower region of the exterior surface by rollers 124 and 126 mounted rotatably in frame 102. Biasing means or spring 128 pivots developer housing 104 until it contacts stop 130. In this position, developer roll 110 is in its non-operative position spaced from photoconductive surface 12. Operation begins when a clutch gear meshes with a gear attached to paddle wheel 106. This causes paddle wheel 106 to revolve clockwise. As paddle wheel 106 starts to rotate, a reaction torque is exerted against developer housing 104 due to the resistance to motion of developer mix 112 which fills developer housing 104. This reaction torque causes housing 104 to rotate clockwise against the force of spring 122 until a stop, shown as a wheel 132, is positioned against drum 10. Rolls 108 and 110 are rotated in conjunction with paddle wheel 106 by a gear (not shown). When the latent image recorded on photoconductive surface 12 has passed development zone 120, development action is discontinued and the developer mix removed from contact with photoconductive surface 12. To achieve this, the drive motor is disconnected from the gear de-energizing the clutch and leaving the gear free to rotate in either direction. Thus, paddle wheel 106, developer roll 110, and transport roll 108 stop rotating, and developer housing 104 is pivoted clockwise by spring 128 until it engages stop 130 in its inoperative position. This completes the cycle. The aforementioned procedure has been described for developer unit 30, however, this procedure is repeated for developer units 32 and 34, respectively.

In the formation of the single color electrostatic latent image without the screen member 18 interposed into the optical light path, developer roll 110 is electrically biased to a voltage sufficient to produce a toner particle density corresponding to a density of about 0.6 of the original document. In particular, developer roll 104 is connected to voltage source 134. Voltage source 134 electrically biases developer roll 110 to about 225 volts. Thus, an electrical bias suitable to produce a power image having a density of about 0.6 that of the original document is produced.

In the preferred embodiment, developer roll 110 includes a non-magnetic tubular member 136, preferably made from an aluminum tube having an irregular or roughened exterior surface. Tubular member 136 is journaled for rotation by suitable means such as ball bearing mounts. A shaft 138, preferably made of steel, is mounted within tubular member 136 and serves as a fixed mounting for magnetic means 140. Magnetic means 140 includes barium ferrite magnets in the form of angular rings arranged with 5 poles on about a 284° arc about shaft 138.

Similarly, transport roll 108 includes a non-magnetic tubular member 142 also preferably made from an aluminum tube having an irregular or roughened exterior surface. Tubular member 142 is journaled for rotation by suitable means such as ball bearing mounts. A shaft 144, preferably made of steel, is concentrically mounted within tubular member 142 and functions as a mounting for magnetic means 146. Magnetic means 146 preferably includes barium ferrite magnets in the form of angular rings arranged with four poles on an arc of 180° about shaft 142.

Each of the developer units 30, 32 and 34 respectively, is actuated by the timing disc (not shown) mounted on the shaft of drum 10. The timing disc is opaque with a plurality of spaced slots in the circumferential periphery thereof. This disc is interposed between an illuminating source and a photosensor to generate an electrical output as each slot permits light rays to pass therethrough. The electrical signal, in association with the machine logic, actuates the appropriate developer unit.

By way of example, voltage source 134 is adjusted so that when screen member 18 is spaced from the optical light path, developer roll 110 is electrically biased to about 600 volts. However, voltage source 134 is switched to a lower voltage level of about 360 volts when screen member 18 is interposed into the optical light path. In this manner, the toner powder image has a density of about 0.6 that of the original document when the screen member is spaced from the optical light path and a density of about 1.0 when the screen member is in the optical light path.

Figure 5:
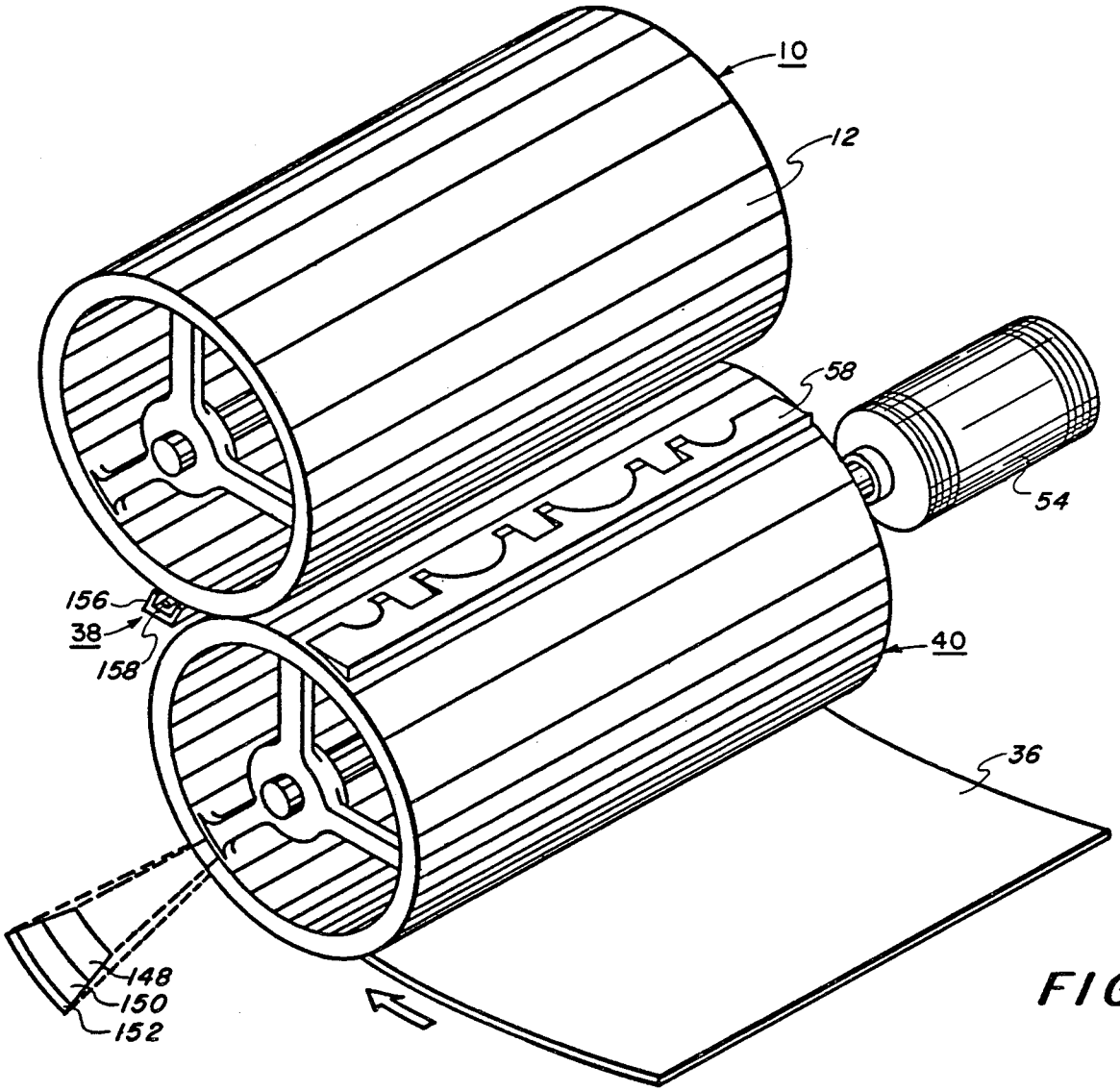
FIG. 5 is a schematic perspective view of the transfer system employed in the FIG. 1 printing machine.

Turning now to FIG. 5, the structural arrangement of transfer D is described therein in detail. Transfer roll 40 includes an aluminum tube 148 having a ¼ inch thick layer of urethane 150 cast thereabout. A polyurethane coating 152, preferably of about 1 mil thick is sprayed over the layer of urethane 150. Preferably, transfer roll 40 has a Shore Hardness ranging from about 10 units to about 30 units on the A scale. The resistivity of transfer roll 40, preferably, ranges from about $10^8$ to about $10^{11}$ ohms/centimeters. A direct current bias voltage is applied by a suitable voltage source (not shown) to aluminum tube 148 by suitable means such as a carbon brush and brass ring assembly (not shown). By way of example, the transfer voltage may range from about 1500 to about 4500 volts. Transfer roll 40 is substantially the same diameter as drum 10. Both roll 40 and drum 10 are driven at substantially the same angular velocity.

Contact between photoconductive surface 12 of drum 10 and transfer roll 40, with support material 36 interposed therebetween is preferably limited to a maximum of about 1.0 lbs. of force per linear inch. A flexible metal bellows 154 couples transfer roll 40 to the drive system of drum 10 so as to permit the movement of transfer roll 40 relative to drum 10 while still rotating transfer roll 40 in synchronism with drum 10. Both of the foregoing members are driven from a common drive motor.

Corona generator 38 includes an elongated shield 156 made from a conductive material such as an aluminum extrusion. Elongated shield 156 is substantially U-shaped and may be grounded or, in lieu thereof, biased to a suitable electrical voltage. A discharge electrode 158 is mounted in the chamber of U-shaped shield 156. Discharge electrode 158 is, preferably, a platinum coronode wire extending longitudinally along the length of shield 156. Coronode wire 158 is excited to produce a flow of ions therefrom. The ion flow is adapted to precondition the toner particles deposited on the electrostatic latent image and halftone electrostatic latent image is of photoconductive surface 12. In this way, the efficiency of transfer roll 40 is enhanced to attract the toner powder image more readily from the latent images recorded on photoconductive surface 12. When the toner particles are pre-conditioned, substantially the entire toner powder image is transferred from photoconductive surface 12 to the sheet of support material 36. Preferably, discharge electrode 158 is excited at about 110 micro-amperes and at about 44 volts RMS, the range being from about 80 micro-amperes at about 3000 volts RMS to about 200 micro-amperes at about 500 volts RMS. The alternating current output from coronode wire 158 to photoconductive surface 12 with the toner powder image thereon ranges from about 3 to about 5 micro-amperes and is preferably about 4 micro-amperes. The foregoing arrangement for transferring the toner powder image to the sheet of support material is described in co-pending application Ser. No. 335,968 filed in 1973, the relevant portions of that being hereby incorporated into the present application.

Figure 6:
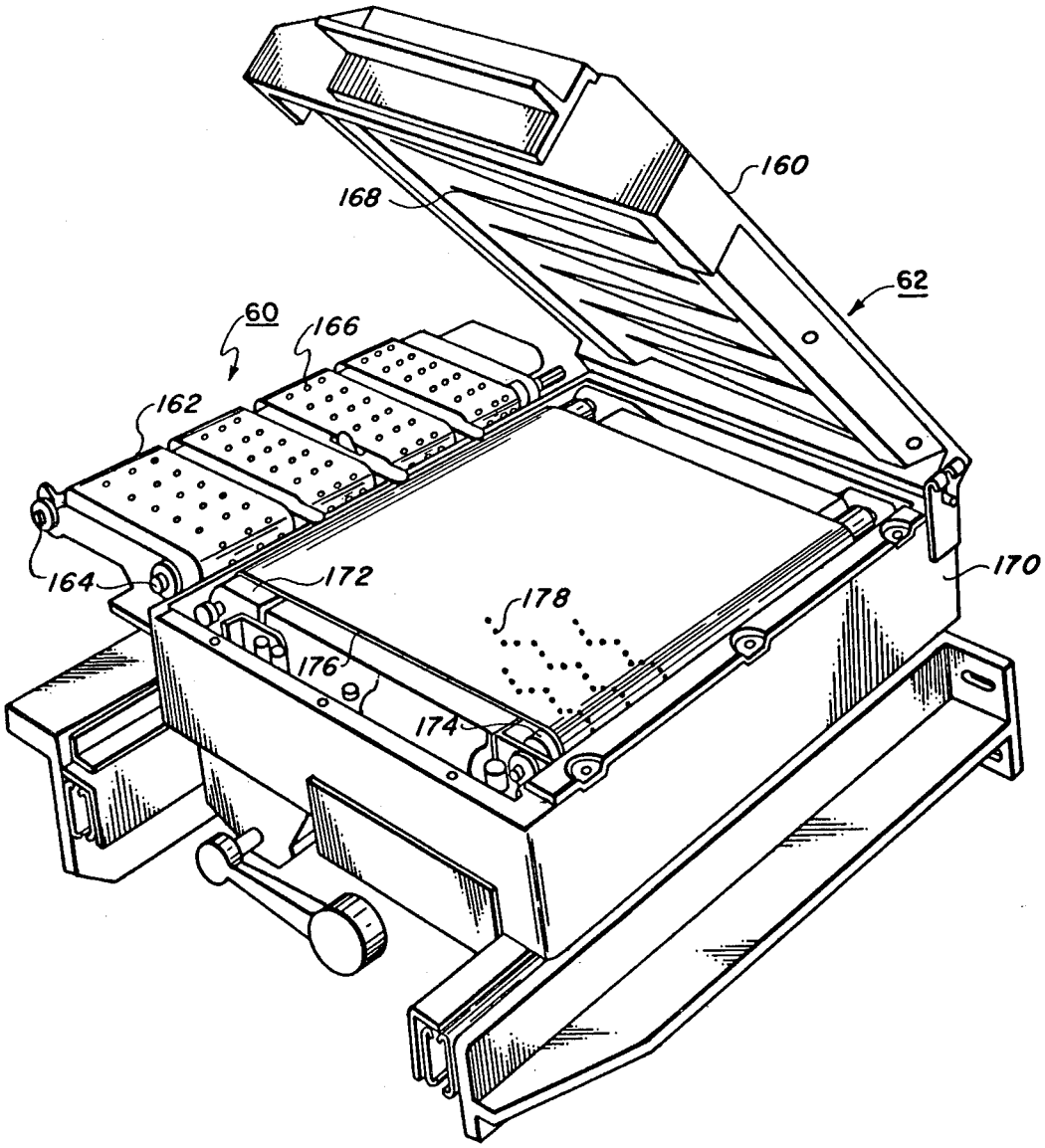
FIG. 6 is a schematic perspective view of the FIG. 1 printing machine fuser.

Referring now to FIG. 6, fuser 62 will be described hereinafter in greater detail. Fuser 62 is depicted as having a cover member 160 pivoted to the open position. Conveyor 60 is associated with fusing apparatus 62 to transport support material 36 from transport roll 40 thereto. Conveyor 60 includes a plurality of endless belts 162 entrained about a pair of opposed spaced rollers 164. A vacuum system maintains a low pressure by drawing air through apertures 166 of belt 162 to tack support material 36 thereto. Cover member 160 includes radiant energy source 168. Lower housing member 170 defines an open ended chamber having a pair of spaced rollers 172 and 174 mounted rotatably on a transport frame disposed therein. An endless belt 176 is entrained about rollers 172 and 174. Endless belt 176 includes a plurality of apertures 178 therein which are arranged to draw air therethrough such that support material 36 is tacked thereto. Preferably, cover 160 includes a sheet metal shell having insulation secured to the interior surface thereof. A nylon fiber coating is sprayed on the exterior surface of cover 160 to protect the operator. An outer reflector is attached to the interior insulation on the metal shell. An inner reflector is mounted on the outer reflector. As mounted, the inner and outer reflectors are spaced from one another permitting air to circulate therebetween. A thermistor is positioned in the air space between the inner and outer reflectors to measure the temperature thereat.

Radiant energy source 168 is preferably a heat strip made from a nickel chromium alloy ribbon entrained helically about a pair of opposed spaced support members, such as ceramic spools. The heat strip provides substantially uniform radiation. A suitable guide, preferably quartz wires is arranged to prevent support material 36 from contacting the heat strips.

The interior surface of endless belt 176 is closely adjacent to a heated plate. The plate is heated by air passing over an auxiliary heater located in lower housing 170. A blower, also positioned in lower housing 170, moves air over the auxiliary heater onto the plate raising the temperature thereof. In this manner, the radiant heat from the heat strips, in conjunction with the heat from the plate fuse the toner powder image formed on support material 36. Fuser 62 is described in greater detail in co-pending application Ser. No. 300,531 filed in 1972, the disclosure of which is hereby incorporated into the present application.

In recapitulation, the combination of six toner powder images, three single color powder images having about 0.6 the density of the original document and three half-tone single color powder images having the same density of the original document results in a high quality multi-color copy.

It is, therefore, apparent that there has been provided in accordance with the present invention, an electrophotographic printing machine which produces high quality copies. This printing machine fully satisfies the objects, aims and advantages hereinbefore set forth. While this invention has been described in conjunction with a specific embodiment and method of use therefore, it is evident that many alternatives, modifications, and variations will be apparent to those skilled in the art. Accordingly, it is intended to embrace all such alternatives, modifications, and variations that fall within the spirit and broad scope of the appended claims.

What is claimed is:

1. A method of reproducing an original document on a sheet of support material, including the steps of:

forming a first powder image having a lower density than the original document on a photoconductive member;

transferring the first powder image from the photoconductive member to a sheet of support material;

producing a half-tone powder image having substantially the density of the original document on the photoconductive member; and transferring the half-tone powder image from the photoconductive member to the sheet of support material in superimposed registration with the first mentioned powder image transferred thereto to produce a copy of the original document therein.

2. A method as recited in claim 1 wherein said step of forming a first powder image includes the steps of:

charging the photoconductive member to a substantially uniform level;

exposing the charged photoconductive member to a light image of the original document recording an electrostatic latent image thereon; and developing the electrostatic latent image with toner particles to form a toner powder image.

3. A method as recited in claim 2, wherein said step of producing a half-tone powder image includes the steps of:

charging the photoconductive member to a substantially uniform level;

creating a light image of the original document;

projecting the light image through a screen forming a modulated light image;

irradiating the charged photoconductive member with the modulated light image recording a modulated electrostatic latent image thereon; and developing the modulated electrostatic latent image with toner particles to form a half-tone powder image.

4. A method as recited in claim 3, further including the step of permanently affixing the superimposed toner powder images to the sheet of support material.

5. A method as recited in claim 4, further including the step of filtering the light image prior to said step of exposing.

6. A method as recited in claim 5, further including repeating said steps of charging, filtering, exposing, developing and transferring for at least two differently colored toner powder images.

7. A method as recited in claim 6, further including said step of filtering the light image prior to said step of projecting.

8. A method as recited in claim 7, further including repeating said steps of charging, creating a light image, filtering, projecting, irradiating, developing, and transferring for at least two differently colored toner powder images.

* * * * *